US007039305B1

(12) United States Patent
Chen

(10) Patent No.: US 7,039,305 B1
(45) Date of Patent: May 2, 2006

(54) HEAT CONDUCTIVE TUBULAR ELECTRIC HEATER

(76) Inventor: Min Jie Chen, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/120,800

(22) Filed: May 4, 2005

(30) Foreign Application Priority Data

May 27, 2004 (TW) ..... 932082288 U

(51) Int. Cl.
*F24H 1/10* (2006.01)

(52) U.S. Cl. ..... 392/490; 392/465; 392/488

(58) Field of Classification Search ..... 392/488, 392/490
See application file for complete search history.

(56) References Cited

U.S. PATENT DOCUMENTS 4,567,350 A * 1/1986 Todd Jr. ..... 392/486
5,216,743 A * 6/1993 Seitz ..... 392/490
5,408,578 A * 4/1995 Bolivar ..... 392/490
5,438,642 A * 8/1995 Posen ..... 392/485
6,246,831 B1 * 6/2001 Seitz et al. ..... 392/486
6,389,226 B1 * 5/2002 Neale et al. ..... 392/485

* cited by examiner

*Primary Examiner*—Thor S. Campbell

(57) ABSTRACT

A heat conductive tubular electric heater is disclosed. In the heater body, a water inlet tube is connected to a heat conductive tube and an electric tube is installed within the heat conductive tube so as to form a water path between a periphery of the electric tube and an interior of the heat conductive tube. When the cool water flows into the water inlet tube entering into the electric heater, the cool water can be heated continuously by the electric tube to increase it's a temperature thereof and is heated. Besides, the heat conductive tube is assembled within a water storage tank of the electric heater for being stored therein for further use. The heater is worthy for industrial uses, because of some advantages thereof, such as heating water fast, high thermal efficiency.

3 Claims, 6 Drawing Sheets

HEAT CONDUCTIVE TUBULAR ELECTRIC HEATER

FIELD OF THE INVENTION

The present invention relates to a heat conductive tubular electric heater, and in particular to a heater body can be used to heat cool water by which the hot water can be obtained for taking a bath or cleaning.

BACKGROUND OF THE INVENTION

Among many ways to heat water, both a gas heater and an electric heater are usually used. The electric heater has already been more and more popular recently since it can be installed conveniently in many places. According to functions of the electric heaters, electric heaters can be divided into two modes, one is a storage mode and the other is an instant heating mode. The disadvantages of a storage heater includes its large size, high price, slow heating. Besides, the hot water stored in a storage heater needs to be kept warm all day long, which causes electric energy to be wasted. In use, the temperature of the hot water will decrease abruptly, because the hot water was not drained out by its heating sequence and was mixed with the entering cool water. For an instant heating heater, it is difficult to adjust a suitable temperature for usage. Although a multi-stage temperature adjuster can be used in an instant heating heater, it is also inconvenient during changes of whether. If the temperature adjuster is installed, the power of the instant heating heater cannot be turned on by a faucet to heat the cool water. In addition, the instant heater needs a great quantity of electric current which causes waste of electric energy.

SUMMARY OF THE INVENTION

The primary object of the present invention is to provide an ideal and practical electric heater. The advantages of the electric heater includes fast heating, and efficient heating, which also includes the advantages of the prior art storage heaters and instant heaters.

To achieve above objects, the present invention provides a heat conductive tubular electric heater. In the heater body, a water inlet tube is connected to a heat conductive tube and an electric tube is installed within the heat conductive tube so as to form a water path between a periphery of the electric tube and an interior of the heat conductive tube. When the cool water flows into the water inlet tube entering into the electric heater, the cool water can be heated continuously by the electric tube to increase its temperature and become hot water. Besides, the heat conductive tube is assembled within a water storage tank of the electric heater, by which the hot water can be stored for waiting usage.

The various objects and advantages of the present invention will be more readily understood from the following detailed description when read in conjunction with the appended drawing.

BRIEF DESCRITION OF THE DRAWINGS

DETAILED DESCRIPTION OF THE INVENTION

Figure 1:
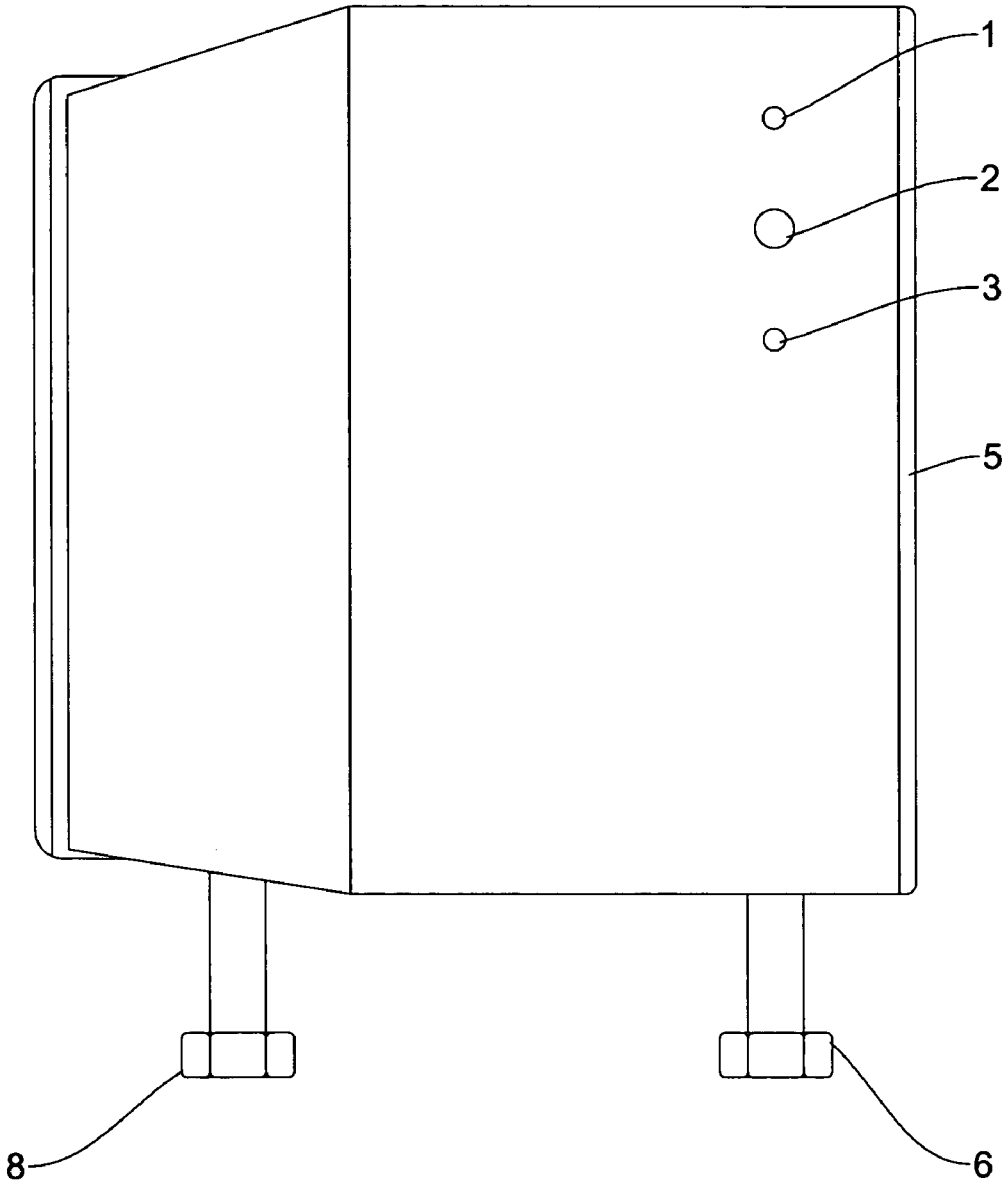
FIG. 1 is a perspective view of the present invention.
Figure 2:
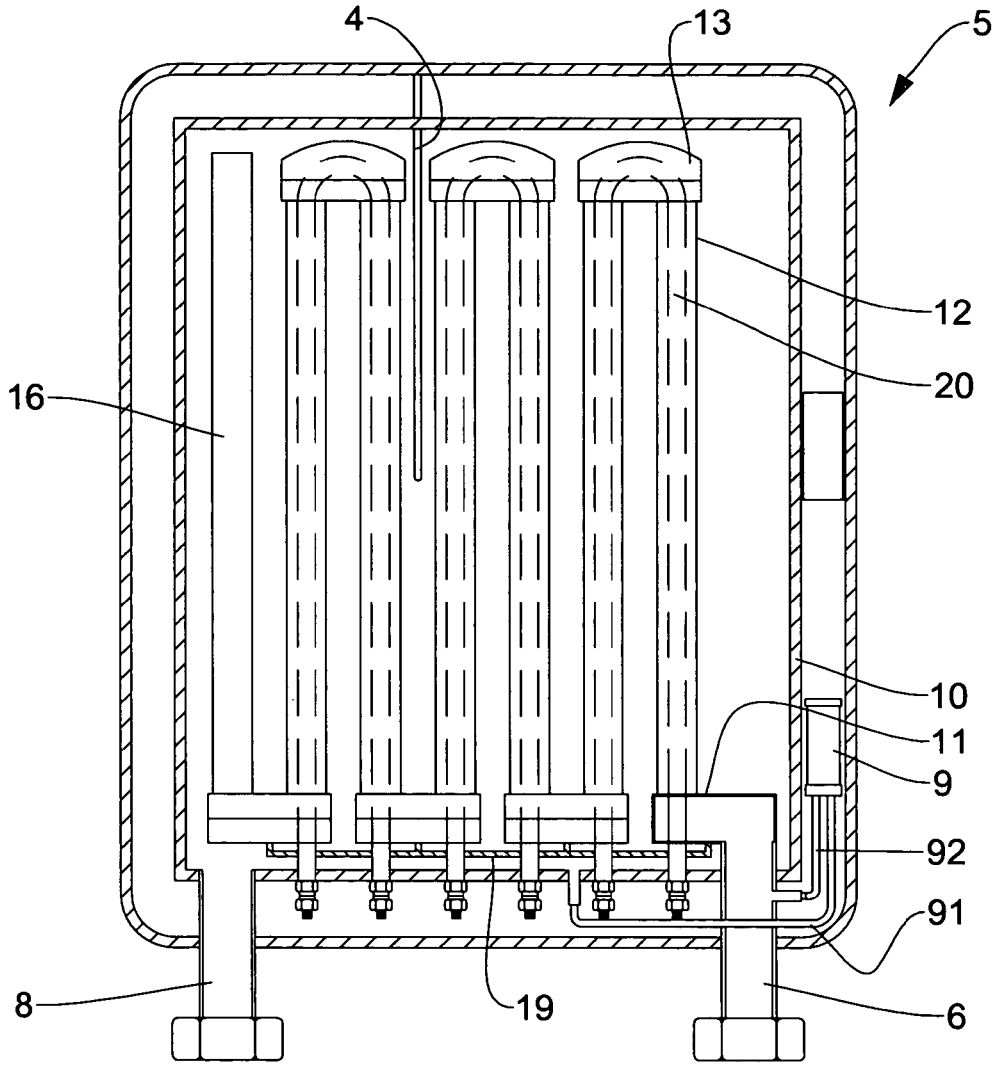
FIG. 2 is a schematic view showing the internal structure of the present invention.
Figure 3:
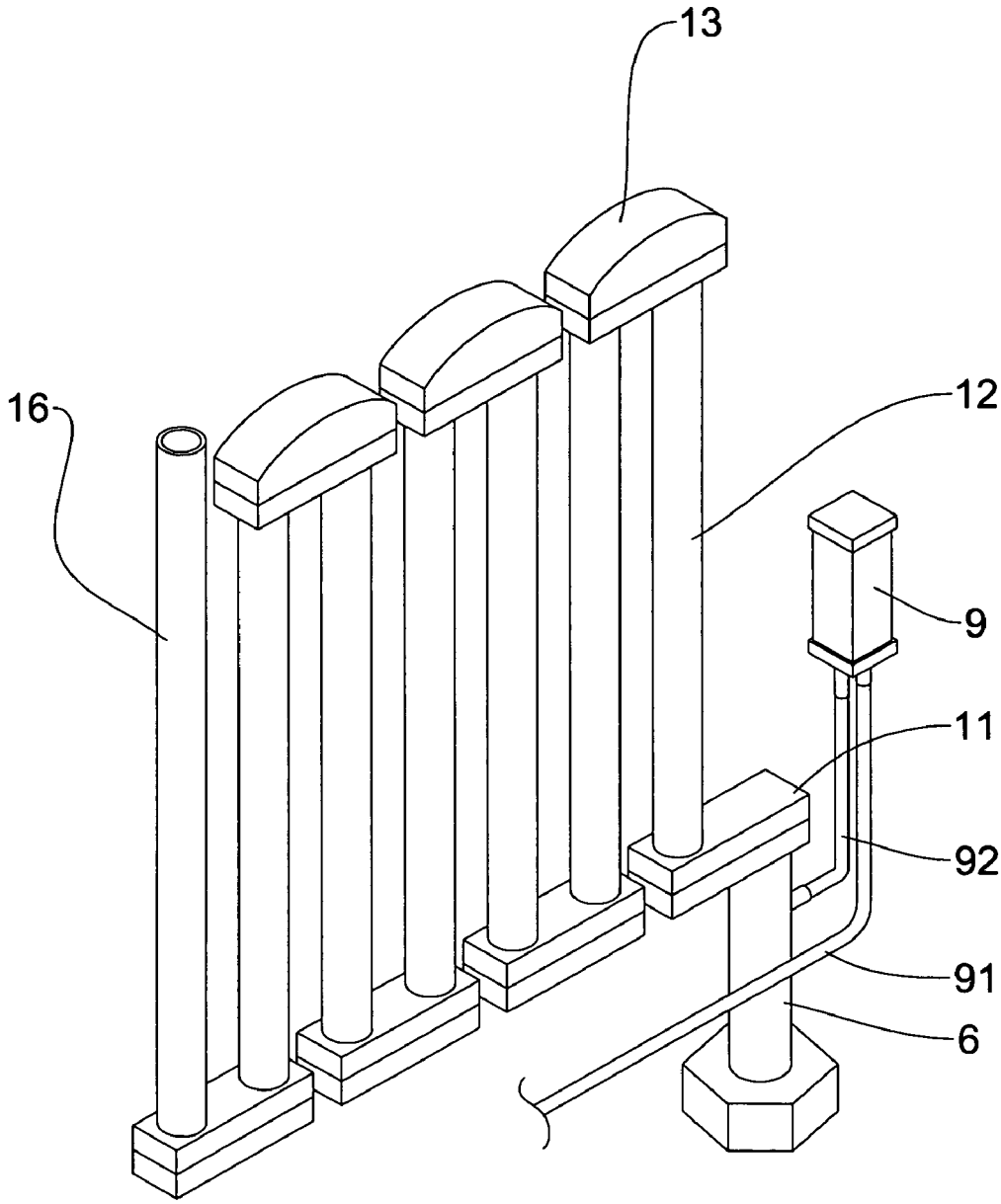
FIG. 3 is a perspective view showing a partial structure of the invention.

Referring to FIGS. 1, 2, and 3, the heat conductive tubular electric heater of the present invention is illustrated. The heat conductive tubular electric heater has the following elements. A body 5 has a water storage tank 10. A water inlet tube 6 and a water outlet tube 8 are assembled to the body 5. The water inlet tube 6 is connected to the water storage tank 10. A heat conductive tube 12 extends from a portion that the water inlet tube 6 enters into the water storage tank 10. The heat conductive tube 12 is multi-folded in the water storage tank 10. A heat electric tube 20 is arranged within the heat conductive tube 12. A water path is formed in a space between an outer periphery of the electric tube 20 and an inner side of the heat conductive tube 12. A water outlet tube 16 is installed at a distal end of the heat conductive tube 12 for inputting hot water into the water storage tank 10. It is preferably that the water drain tube 16 is faced upwards.

The heat conductive tube 12 may be installed with positioning elements 11, connecting elements 13, and retaining plates 19. A temperature sensing element 4 is installed within the water storage tank 10 for measuring the temperature of an interior of the water storage tank 10. Furthermore, a heating indicator 1, a temperature controller 2 and a switch are installed at the body 5 for displaying the operation states.

Figure 4:
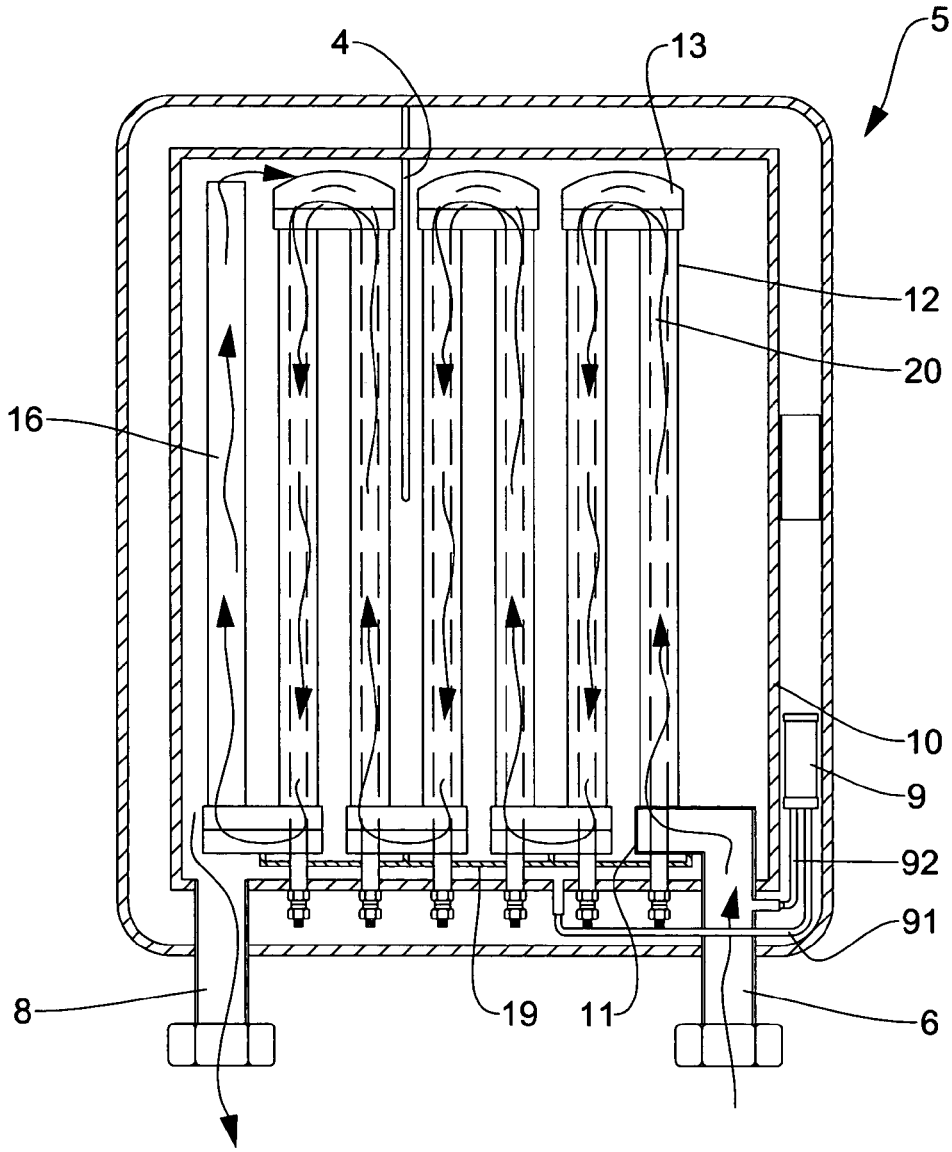
FIG. 4 is a schematic view showing the operation of the invention.

Referring to FIGS. 3 and 4, the operation of the present invention will be described. In operation, cool water enters into the water drain tube 16 and passes through an interior of the positioning element 11 to be guided into the heat conductive tube 12. Since the electric tube 20 is installed within the heat conductive tube 12, cool water is heated continuously and sufficiently so as to increase the temperature thereof so as to become hot water. Then the hot water is filled into the water storage tank 10 to be used afterwards. In use, the hot water flows out of the water outlet tube 8 of the water storage tank 10.

In the present invention, the heat conductive tube 12 is used to heat cool water. The cool water is heated by flowing through some distances of the heat conductive tube 12. In particular, the water flows through the small tube and nearly closes to the heat electric tube 20. Thus, the water is heated efficiently in a very short time. Dirt will not be left in the water storage tank 10 after water flows through it. Surplus water can be stored in the water storage tank 10 so as to supply instant hot water for using conveniently without limitation of times of uses. In addition, the cool water is heated sequentially by flowing through the tube, then the hot water is sent to the water storage tank 10. Thus, cool water and hot water will not be mixed to enhance heating efficiently.

Figure 5:
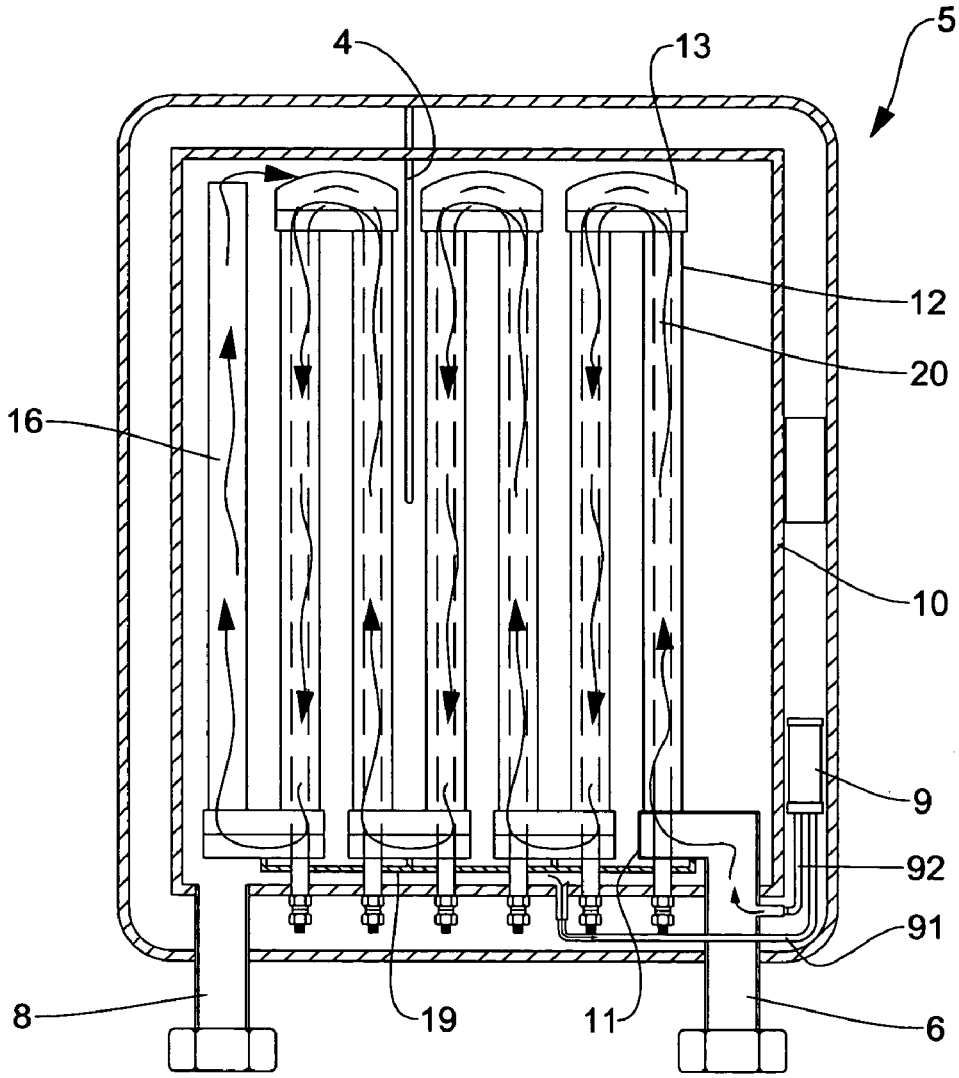
FIG. 5 is a schematic view showing the pumping operation of the present invention.
Figure 6:
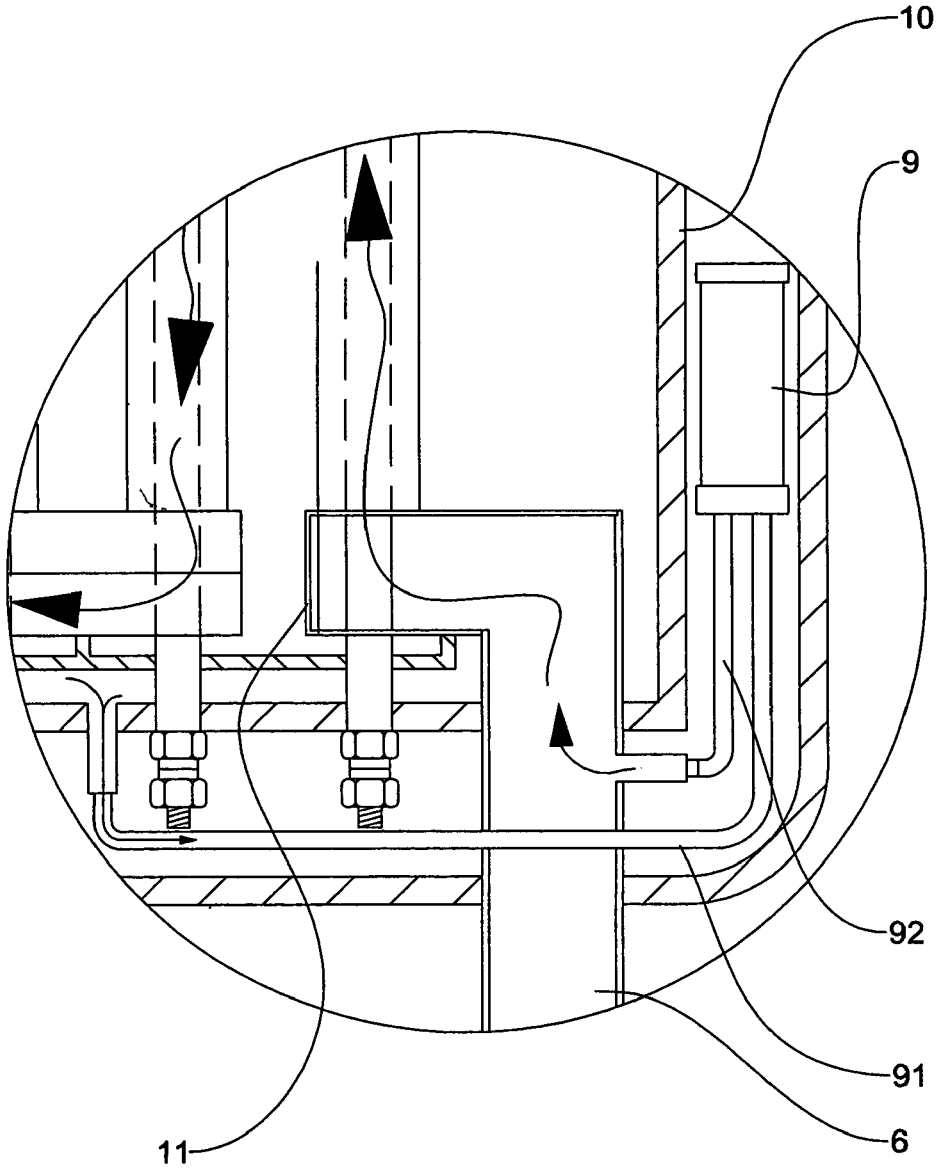
FIG. 6 is a partial enlarged view of FIG. 5.

The hot water is stored in water storage tank 10 after it flows through the water drain tube 16. If the hot water is not used immediately, then the hot water will cool down. Referring to FIGS. 2 and 3, a water pump 9, a first tube 91 and a second tube 92 are installed within the water storage tank 10 in order to efficiently use the cool water stored in water storage tank 10 for next time use and also to heat the cool water uniformly and quickly. One end of the first tube 91 is connected to a bottom of the water storage tank 10 on a predetermined, and the other end is connected to the water pump 9. One end of the second tube 92 is connected to water inlet tube 6 on a predetermined, and the other end is connected to the water pump 9. In ordinary situation, the water pump 9 is not actuated, and thus both the first tube 91 and the second tube 92 are not actuated, as illustrated in FIG. 4. While the electric heater is turned on for preheating the cool water for future usage, the water pump 9 is actuated. The cool water which stored in water storage tank 10 is inputting into the first tube 91, pumping it from water pump 9 to the second tube 92 and delivering it to the water inlet tube 6. Then the cool water is entered into heat conductive tube 12 to be heated by the electric tube 20, by which the cool in the electric heater can be heated circularly, as illustrated in FIGS. 5 and 6. Because the heat conductive tube 12 of the electric heater has already been heated by the electric tube 20 for a time period, it should be warmed up to a higher temperature. When the cool water enters into the water inlet tube 6 and then to be guided into the heat conductive tube 12, the cool water is heated as soon as possible. Therefore, the electric energy will not be wasted too mush for heating by the electric tube. So the present invention has several advantages, such as heating fast, saving electric energy and high thermal efficiency.

Because the water temperature is detected by the temperature sensing element 4, the temperature sensing element 4 can control automatically the heating operation of the heat conductive tube 12. Thus the surplus water in the water storage tank 10 can be used efficiently and be heated evenly. The invention matches the the requirement for saving water by which the cool water does not be drained out and causes waste at the beginning of usage.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A heat conductive tubular electric heater comprising:

a heater body;

a water storage tank installed within the heat body for storing water;

a water inlet tube assembled to the water storage tank for supplying water;

a heat conductive tube installed within a water outlet tube; the heat conductive tube having multi-folds in the water storage tank;

an electric tube installed within the heat conductive tube so as to form a water path between an periphery of the electric tube and an interior of the heat conductive tube; one end of the heat conductive tube being connected to the water outlet tube; and a water drain tube having an water outlet opening for releasing water into an interior of the water storage tank so as to leave from the water conductive tube;

a water outlet tube connected to a predetermined position of the water storage tank so that water can output from the water outlet tube, wherein the heat conductive tube is formed with a plurality of positioning elements at a lower side of the water storage tank for positioning the heat conductive tube, a plurality of connecting elements at a lower side of the water storage tank for connecting different parts of the water conductive tube, and a plurality of retaining plates for retaining the water positioning elements, wherein a water pump, a first tube and a second tube are installed within the water storage tank; the one end of the first tube 91 is connected to the bottom of the water storage tank, and the other end thereof is connected to the water pump; one end of the second tube is connected to water inlet tube, and the other end is connected to the water pump.

2. The heat conductive tubular electric heater as claimed in claim 1, wherein a temperature sensing element is installed in the water storage tank.

3. The heat conductive tubular electric heater as claimed in claim 1, wherein a heating indicator, a temperature controller and a switch are installed at the body.

* * * * *